United States Patent [19]

Overman, Sr. et al.

[11] Patent Number: 4,694,516

[45] Date of Patent: Sep. 22, 1987

[54] PLAYPEN SUN COVER

[76] Inventors: Patrick Overman, Sr., 9704 Southeast 7th St.; Elldon Baird, 10010 N.E. 6 Circle, both of Vancouver, Wash. 98664

[21] Appl. No.: 822,154

[22] Filed: Jan. 24, 1986

[51] Int. Cl.[4] ..... A47C 29/00

[52] U.S. Cl. ..... 5/93 R; 5/97; 5/113; 5/414

[58] Field of Search ..... 5/93 R, 99 A, 97, 113, 5/414, 416, 508, 512, 513; 135/107, 109, 75

[56] References Cited

U.S. PATENT DOCUMENTS

| | | | |
|---|---|---|---|
| 185,157 | 12/1876 | Baker | 5/414 |
| 1,211,762 | 1/1917 | Sawyer | 5/93 R |
| 1,633,820 | 6/1927 | Long et al. | 5/113 |
| 1,909,467 | 5/1933 | Hirose et al. | 5/414 |
| 2,584,432 | 2/1952 | De Marco | 135/109 |
| 2,739,320 | 3/1956 | Kostka | 5/498 |
| 3,428,971 | 2/1969 | Finley | 5/93 R |
| 4,043,349 | 8/1977 | Gays et al. | 5/97 |
| 4,044,784 | 8/1974 | Smith | 135/75 |

*Primary Examiner*—Gary L. Smith
*Assistant Examiner*—Michael F. Trettel
*Attorney, Agent, or Firm*—H. Jay Spiegal

[57] ABSTRACT

Disclosed herein is a playpen sun cover designed to fit over an existing playpen and have adjustability both to accommodate to different sized playpens and also to enable the adjustment of the angle of pitch of the sides of the roof thereof. The device includes coupling devices which enable it to be rigidly affixed to the playpen and includes two roof halves pivotally connected together at a pivot. In order to enable the pitch of the cover to be adjusted while the cover is installed on a particular playpen, each of the elongated legs thereof includes a telescoping feature enabling each leg to be extended in length so as to facilitate changes in the pitch thereof. The roof material is elongated lengthwise sufficiently to enable the pitch of the cover to be adjusted through a wide range of variations while maintaining the entirety of the playpen suitably covered thereby.

11 Claims, 8 Drawing Figures

PLAYPEN SUN COVER

BACKGROUND OF THE INVENTION

The present invention relates to a playpen sun cover. In the prior art, various attempts have been made to provide a cover for a playpen or like object but nothing in the prior art known to Applicants exists which comprises a playpen sun cover not only adaptable to playpens of differing sizes but also adjustable as to the pitch of the roof thereof. The following prior art is known to Applicant:

U.S. Pat. No. 2,865,387 to Annibaldi discloses a collapsible tent having a roof of a substantially conical configuration. This reference is believed to be of only general interest concerning the teachings of the present invention since the roof is neither adjustable for adaptation to different tents nor is its peak height adjustable.

U.S. Pat. No. 4,073,017 to Stevens discloses a portable playpen having a cover therefor, however, this patent is believed to be of only general interest concerning the teachings of the present invention since the cover is only specifically designed for one particular size of playpen and there is no way to adjust the cover for different sized playpens or to adjust the slant of the wall surfaces thereof.

Accordingly, a need has developed for a playpen sun cover which may be utilized on playpens of differing sizes and may have further adjustment of the peak height thereof.

SUMMARY OF THE INVENTION

The present invention overcomes the deficiencies found in prior art designs as exemplified by the above-discussed U.S. patents by providing an improved playpen sun cover having the following interrelated elements:

(a) In a first aspect of the present invention, the inventive cover includes a frame consisting of two halves connected together at a pivot point.

(b) A covering fabric covers the frame and overlies the pivot point, which pivot point defines a central portion of the cover and which enables the peak height of the cover to be adjusted.

(c) At each end of the inventive cover, a plurality of fastening means are provided which enable the cover to be rigidly attached to the top portions of a playpen. These fastening means are easily adjustable for playpens having slats of different dimensions and may easily be attached to and removed from the playpen.

(d) The present invention is unique in that the peak height is adjustable while the playpen sun cover is rigidly affixed to the playpen. For this purpose, the inventive cover includes a plurality of elongated frame members, each of which has a telescoping feature enabling it to be elongated and shortened. Thus, with such structure, with the cover rigidly affixed to the playpen, this telescoping feature of the elongated frame members may be utilized to enable the peak height to be adjusted while so attached.

(e) Of course, when the peak height is adjusted while the sun cover is affixed to the playpen, the covering fabric begins to be taken up from the ends of the cover. For this purpose, the covering fabric is made with elongated portions at its ends so that even if the peak height is adjusted to its maximum height, enough fabric is present to completely cover all peripheral portions of the playpen. In order to secure the elongated fabric ends after the peak height has been adjusted, suitable fastening means is provided between the covering fabric and lateral frame members such as, for example, hook and pile fastening means.

Accordingly, it is a first object of the present invention to provide an improved playpen sun cover.

It is a further object of the present invention to provide an improved playpen sun cover having esthetic value as well as versatility to enable it to be used on playpens of differing configurations.

It is a still further object of the present invention to provide such a playpen sun cover with means allowing it to be rigidly attached to the top of a playpen.

It is a still further object of the present invention to provide such a playpen sun cover having means enabling its peak height to be adjustable while it is rigidly affixed to a playpen.

It is a still further object of the present invention to provide such a playpen sun cover with telescoping means allowing it to elongate and with overlying fabric portions which enable the cover to completely cover all peripheral portions of the playpen even when the peak height has been adjusted.

These and other objects, aspects and features of the present invention will be better understood from the following detailed description of the preferred embodiments when read with reference to the following drawing FIGURES.

SPECIFIC DESCRIPTION OF THE PREFERRED EMBODIMENTS

Figure 1:
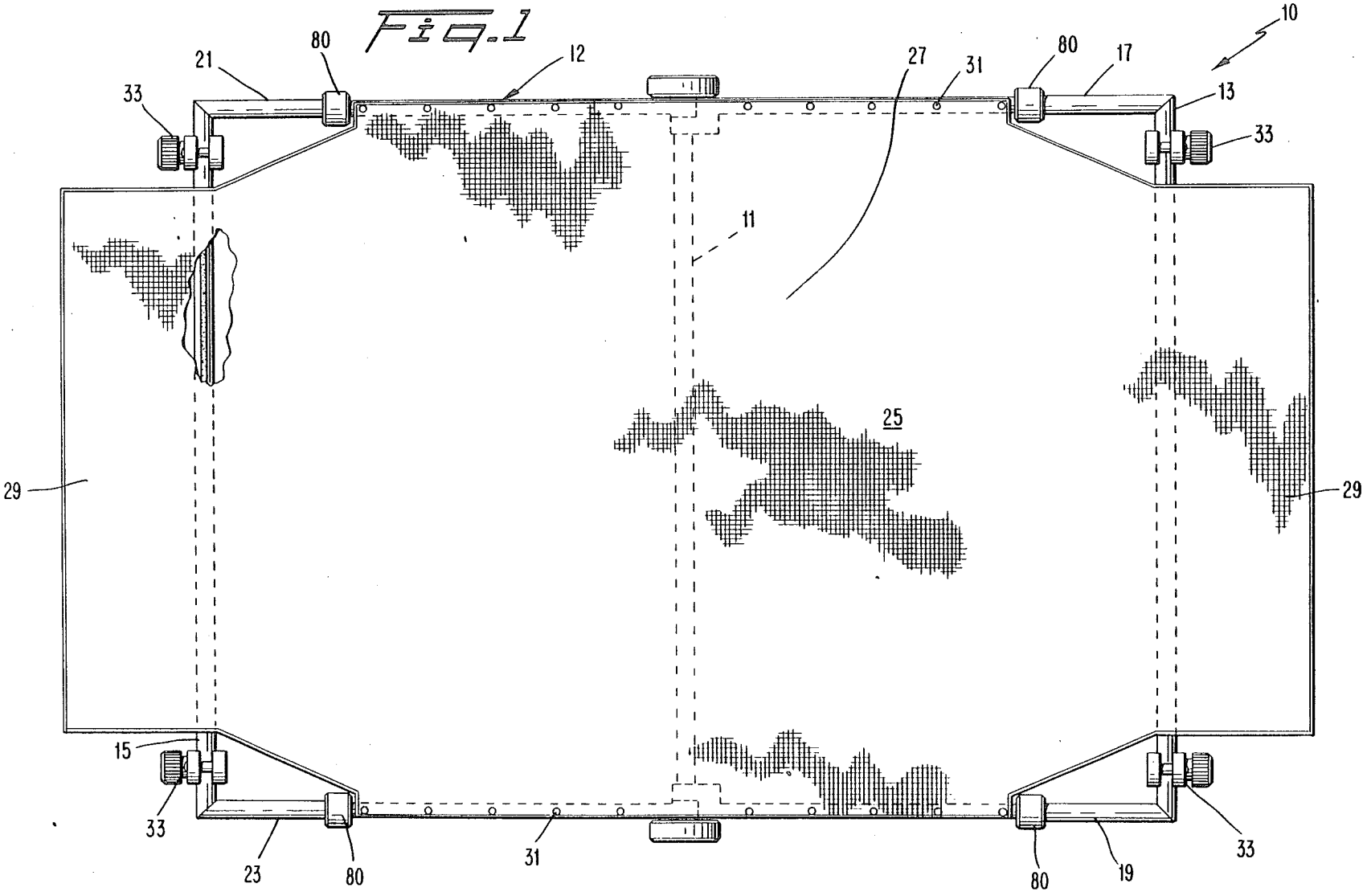
FIG. 1 shows a top view of the present invention.

With reference now to FIG. 1, the present invention is designated, generally, by the reference numeral 10 and includes a main rod 11 shown in phantom in FIG. 1, end rods 13 and 15, and side rods 17, 19, 21 and 23. The rods 13, 15, 17, 19, 21 and 23 combine with the main rod 11 to form a frame generally designated by the reference numeral 12.

Figure 6:
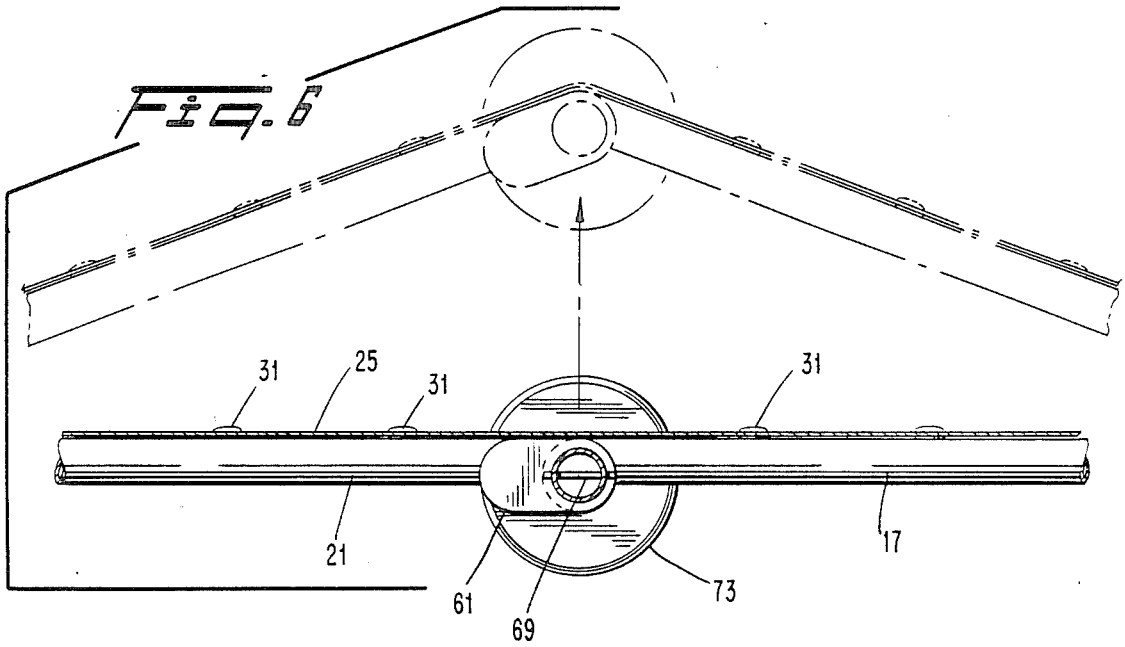
FIG. 6 shows a side view of the structure shown in FIG. 5 including a phantom depiction of the adjustability thereof.

As shown in FIG. 1, the frame 12 is covered by covering fabric 25 including a central portion 27 and overhanging end portions 29 provided for a purpose to be described in greater detail hereinafter. As further shown in FIGS. 1 and 6, the fabric 25 is secured to the side rods 17, 19, 21 and 23 by suitable fastening means such as snaps 31 or the like.

In a further aspect, the underside of the fabric 25 in the region of the overhanging end portions 29 may be covered with one-half of a hook and pile fastening means while the top portions of the end rods 13 and 15 may be covered with the other half of a hook and pile fastening means. Thus, in this manner, the overhanging end portions 29 may be releasably connected over the end rods 13 and 15.

Figure 2:
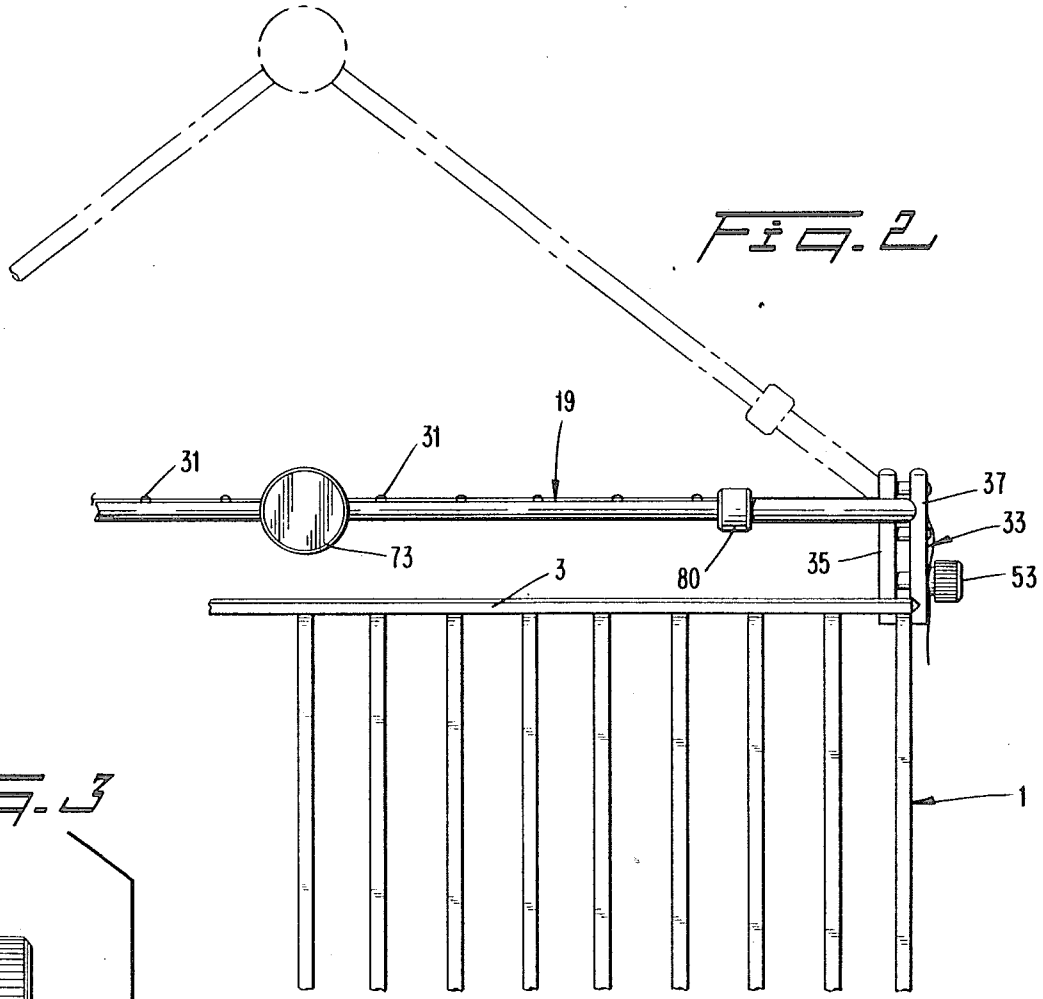
FIG. 2 show a side view of the present invention as installed on a playpen.
Figure 4:
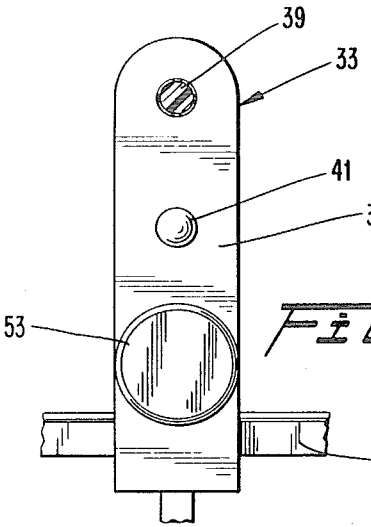
FIG. 4 shows an end view of the fastening means of FIG. 3.
Figure 3:
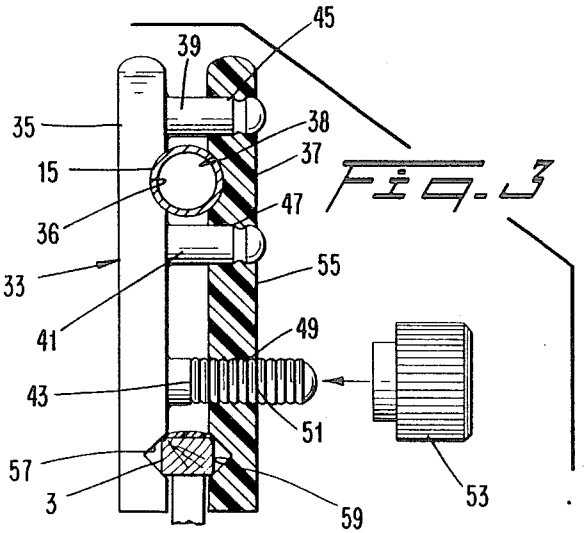
FIG. 3 shows a side view partially in section of the means for fastening the cover to the playpen.

With more particular reference to FIGS. 2, 3 and 4, the frame 12 is connected to the playpen 1 by fastening means generally designated by the reference numeral 33. As shown in FIG. 3, the fastening means 33 includes a first half 35 and a second half 37 with the first half 35 including the pegs 39, 41 and 43 which may extend through the respective corresponding holes 45, 47 and 49 which extend through the second half 37. As shown, the pegs 39 and 41 have external structure which interacts with the internal structure of the respective holes 45 and 47 so as to facilitate the mounting of the halves 35 and 37 together with a "snap-fit". The peg 43 includes threads 51 about its periphery and an internally threaded knob 53 may be threaded over the peg 43 and then tightened about the surface 55 of the second half 37 to suitably clamp the halves 35 and 37 together.

As shown in FIG. 3, the first half 35 includes an arcuate recess 36 while the second half 37 includes an arcuate recess 38 which recesses face one another and are provided to surround, in assembly, one of the end rods in this case, the end rod 15. Furthermore, the first half 35 includes a recess 57 which faces a similar recess 59 in the second half 37. These recesses 57 and 59 are provided to enable the fastening means 33 to be clamped about the top rail 3 of the playpen 1 to thereby fasten the frame 12 and thereby the playpen sun cover 10 thereto.

Figure 5:
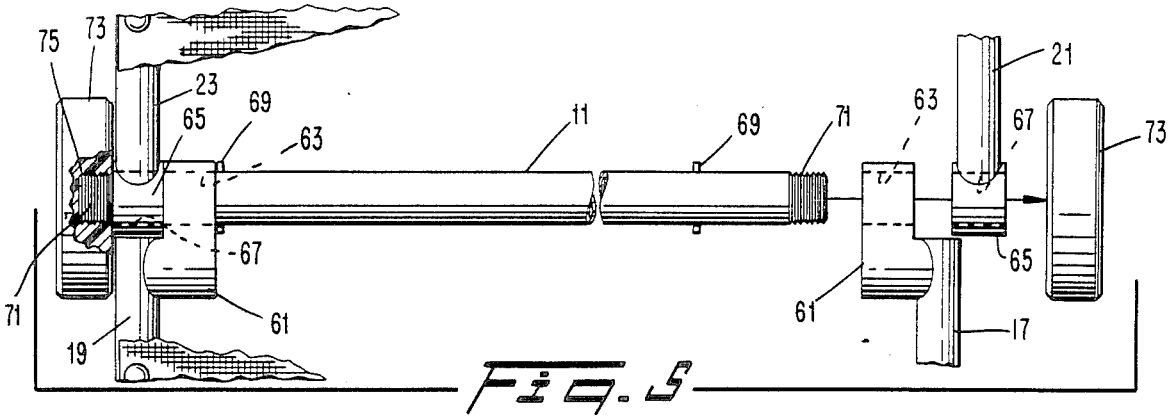
FIG. 5 shows a top view of the structure of the cover enabling the cover to be pivoted so as to enable adjustment of the peak height, with certain parts partially broken away to show detail.

As stated above, the main rod 11 provides a pivot enabling the frame 12 to be pivoted so as to adjust the peak height of the fabric 25. In this regard, specific reference is made to FIGS. 5 and 6 wherein it is seen that the main rod 11 has associated therewith the pivoting structure. With particular reference to FIG. 5, it is seen that the rods 17 and 19 terminate in respective mirror imaged L-shaped portions 61 each of which has an opening 63 therethrough. On the other hand, the rods 21 and 23 terminate in end portions 65 having openings 67 therethrough adapted to be aligned with the openings 63 through the members 61. As shown in FIG. 5, the end portions 65 are designed to nest within the end portions 61 in a neat assembly.

The main rod 11 includes spaced from its ends pegs 69 which define the extent to which the members 61 and 65 may be slid over the main rod toward the center thereof. As shown on the left side of FIG. 5, the pegs 69 are designed so that inner faces of the members 61 bear thereagainst. Further, the location of the pegs 69 is specifically designed so that with the members 61 and 65 installed over the main rod 11 as shown on the left hand side of FIG. 5, there is a slight spacing between outer faces of the members 65 and threaded portions 71 of the main rod 11. Knobs 73 are provided with internal threads 75 which allow the knobs 73 to be threaded over the threaded portions 71 of the main rod 11 to thereby secure the members 61 and 65 thereto. The above-described spacing between outer faces of the members 65 and the threaded portions 71 is provided so that the members 63 and 65 along with their respective attached rods may pivot without binding.

Figure 7:
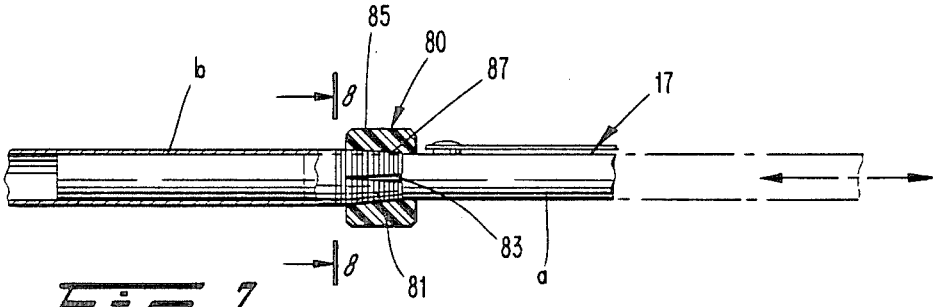
FIG. 7 shows a cross-sectional view through an aspect of the present invention enabing the telescoping adjustment of certain frame members thereof.
Figure 8:
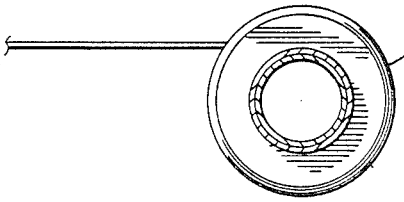
FIG. 8 shows a cross-sectional view along the line 8—8 of FIG. 7.

As mentioned above, when the frame 12 is pivoted to adjust the peak height thereof, provision must be made to allow the rods 17, 19, 21 and 23 to be extended to accomodate for such adjustments. In this regard, reference is made to FIGS. 1, 2, 7 and 8 which show details of telescoping means 80 which is provided on each of the rods 17, 19, 21 and 23. In FIGS. 7 and 8, the telescoping means 80 is shown in particular on the rod 17 and the same structure is utilized on each of the rods 17, 19, 21 and 23.

Again, with reference to FIGS. 1, 2, 7 and 8, the telescoping means 80 is seen to include a first rod section a sized and dimensioned so as to slidably fit within a second rod section b. The rod section b has an end with threads 81 on its outer periphery and a split 83 of wedge-shaped configuration. A nut 85 is provided extending over the rod section a and having an internal truncated conical threaded surface 87 adapted to be threaded over the threaded portion 81 of the rod section b. Thus, when the nut 85 is loosened from the threaded portion 81, the split 83 enables the rod section b to be loosened somewhat so as to enable sliding between the rod sections a and b. When the correct position of the playpen sun cover 10 has been achieved, the nut 85 may be tightened over the threaded surface 81 to thereby tighten the device 80 and thereby fix the rod sections a and b in stationary relation with respect to one another.

As seen in FIG. 1, and as stated above, each of the rods 17, 19, 21 and 23 includes a telescoping means 80 and when it is desired to raise the peak height by pivoting the frame 12 about the main rod 11, with each of the fastening means 33 affixed to the top rails 3 of the playpen 1, it is necessary to loosen each of the telescoping means 80, whereupon the peak height of the cover 10 may be adjusted through pivoting of the respective members 61 and 65 about the main rod 11 to thereby elevate or lower the peak height as shown in full lines and phantom lines in FIG. 2. After the desired height has been achieved, the telescoping means 80 may be tightened so as to fix the cover 10 in a stationary position. In a further aspect, as stated above, the overhanging end portions 29 of the fabric 25 may be removably affixed to the respective end rods 13 and 15 by hook and pile fastening means, one-half of which is affixed to the underside of the overhanging end portions 29 and the other half of which is affixed to the top portion of the end rods 13 and 15. Thus, in the operation described above, wherein the peak height is adjusted, prior to such adjustments, the overhanging end portions 29 may be slightly lifted to remove them from their temporarily fastened connection to the end rods 13 and 15 via such hook and pile fastening means. While other fastening means may be contemplated to removably fasten the overhanging end portions 29 to the end rods 13 and 15, hook and pile fastening means has been found to be the best way to make such a connection since it enables the infinite adjustment of the relationship between the overhanging end portion 29 and the respective end rods 13 and 15 which thereby allows the infinite adjustment of the particular peak height of the frame 12 and thereby of the cover 10.

The present invention in its many components may be made of any suitable materials. For example, all of the various rods and connections may be made of plastic tubing, or if desired, of aluminum tubing. The fastening means 33 as well as the telescoping means 80, the knobs 73, etc. may also, if desired, be made of plastic although these components may also be made of any other suitable material such as for example metal. It is important to note that the materials from which the present invention is made should be chosen so as to maintain the lightweight nature of the invention while enabling the invention to be easily assembled, adjusted and washed. In the preferred embodiment, the cover 25 should be made of a material that may include a light reflecting substance which is easy to wipe clean with the light reflecting nature thereof being provided so as to maintain the interior of the playpen at a comfortable temperature.

Of course, while the present invention has been described as being intended for use with a playpen, of course, the present invention may be utilized to cover any suitable enclosure. Of course, the combination of the telescoping means 80 and the pivoting associated with the main rod 11 allows the inventive device 10 to be utilized on playpens of differing sizes and configurations only limited by the degree to which the rods 17, 19, 21 and 23 may be extended and retracted due to the telescoping nature thereof.

Accordingly, an invention has been disclosed hereinabove in terms of a preferred embodiment thereof. Various changes, modifications and alterations in the teachings of the present invention may be contemplated by those skilled in the art without departing from the intended spirit and scope of the present invention. Accordingly, it is stressed that it is intended that the present invention only be limited by the terms of the appended claims.

We claim:

1. An improved sun cover comprising:
(a) a frame removably attachable to an enclosure;
(b) covering means removably and adjustably attached over said frame;
(c) said frame including side rods pivotably connected to one another to enable said cover to be adjusted to different configurations;
(d) said side rods pivoting about a main rod centrally located in said frame and disposed substantially perpendicular to said side rods, said side rods including first and second substantially parallel side rods to one side of said main rod and third and fourth substantially parallel rods to another side of said main rod, said first and third rods being pivotable with respect to one another and said second and fourth rods being pivotable with respect to one another;
(e) a first end rod substantially parallel to said main rod and mounted on ends of said first and third side rods remote from said main rod, and a second end rod substantially parallel to said main rod and mounted on ends of said second and fourth side rods remote from said main rod;
(f) said frame being removably attachable to said enclosure by fastening means connected to said end rods, said fastening means comprising at least one fastener on each end rod and comprising:
(1) two facing clamping halves including interengaging structure enabling the halves to be moved toward and away from one another;
(2) a first recess between said halves and adapted to surround one of said end rods;
(3) a second recess between said halves and adapted to surround a top portion of said enclosure; and
(4) adjusting means for controllably tightening said halves about said one of said end rods and said top portion substantially simultaneously.

2. The invention of claim 1, wherein said side rods include ends aligned with one another and each end having an opening therethrough, said main rod extending through said openings and thereby defining a pivot point for said side rods.

3. The invention of claim 1, wherein said adjusting means comprises a threaded peg on one of said halves extending through an opening in the other of said halves and an internally threaded knob threaded over said threaded peg and adapted to bear against a side face of said other of said halves to clamp said halves about said rod and said top portion of said enclosure.

4. The invention of claim 1, wherein said enclosure comprises a playpen.

5. The invention of claim 1, wherein each of said side rods is adjustable as to its length.

6. The invention of claim 5, wherein each side rod includes telescoping means and locking means for locking each side rod in a desired telescoped length.

7. The invention of claim 5, wherein said covering means is removably attached to said side rods and adjustably attached to said end rods.

8. The invention of claim 7, wherein said covering means includes elongated end portions having underside surfaces covered with one half of a hook and pile fastener, and top surfaces of said end rods being covered with the other half of said hook and pile fastener.

9. The invention of claim 1, wherein said rods are made of plastic.

10. The invention of claim 1, wherein said covering means includes top surfaces made of a heat and light reflecting material.

11. An improved sun cover comprising:
(a) a frame removably attachable to an enclosure;
(b) covering means removably and adjustably attached over said frame;
(c) said frame including side rods pivotably connected to one another to enable said cover to be adjusted to different configurations;
(d) an end rod connected to at least one of said side rods, said frame being removably attachable to said enclosure by fastening means connected to said end rod;
(e) said fastening means comprising:
(1) two facing clamping halves including interengaging structure enabling the halves to be moved toward and away from one another;
(2) a first recess between said halves and adapted to surround said end rod;
(3) a second recess between said halves and adapted to surround a top portion of said enclosure; and
(4) adjusting means for controllably tightening said halves about said end rod and said top portion substantially simultaneously.

* * * * *